US005183175A

United States Patent [19]

Brown

[11] Patent Number: 5,183,175

[45] Date of Patent: Feb. 2, 1993

[54] TRASH RECEPTACLE ASSEMBLY

[76] Inventor: Robert L. Brown, P.O. Box 1657, Umatilla, Fla. 43784-1657

[21] Appl. No.: 850,131

[22] Filed: Mar. 12, 1992

[51] Int. Cl.[5] ..... B65F 1/08

[52] U.S. Cl. ..... 220/408; 220/908; 220/254

[58] Field of Search ..... 220/908, 909, 410, 408, 220/254, 402, 409

[56] References Cited

U.S. PATENT DOCUMENTS

| | | | |
|---|---|---|---|
| 180,277 | 7/1876 | Schmitt . | |
| D. 270,677 | 9/1983 | Creske | D34/8 |
| 330,201 | 11/1885 | Baynes | 220/409 |
| 696,832 | 4/1902 | Maschke | 220/402 |
| 722,766 | 3/1903 | Stephenson | 220/409 |
| 1,203,952 | 11/1916 | Woods | 220/908 |
| 1,511,982 | 10/1924 | Schilling | 220/908 |
| 2,322,439 | 6/1943 | Heithoff | 312/155 |
| 2,490,790 | 12/1949 | Emerson | 220/1 |
| 3,096,900 | 7/1963 | Breneman | 220/4 |
| 3,115,986 | 12/1963 | Groff | 220/63 |
| 3,306,486 | 2/1967 | Martino et al. | 220/1 |
| 3,394,832 | 7/1968 | McAllister et al. | 220/908 |
| 3,675,810 | 7/1972 | Ross, Jr. et al. | 220/402 |
| 3,734,340 | 5/1973 | Ippolito et al. | 220/908 |
| 3,937,335 | 2/1976 | Engebretsen | 220/63 R |
| 4,081,105 | 3/1978 | Dagonnet et al. | 220/908 |
| 4,572,400 | 2/1986 | Sosa | 220/908 |
| 4,883,189 | 11/1989 | Lobbert | 220/908 |

FOREIGN PATENT DOCUMENTS

| | | | |
|---|---|---|---|
| 458268 | 7/1949 | Canada | 220/408 |
| 3524781 | 1/1987 | Fed. Rep. of Germany | 220/909 |
| 2152801 | 8/1985 | United Kingdom | 220/908 |

*Primary Examiner*—Allan N. Shoap
*Assistant Examiner*—S. Castellano
*Attorney, Agent, or Firm*—Edward M. Livingston

[57] ABSTRACT

A trash receptacle assembly having an outer container (2), inner rigid lining (10) and top lid (1). The outer container (2) and the inner lining (10) have matching hand indentations (17) and cut-outs (12), respectively, to make removal of the inner lining (10) much easier when filled with trash. The top lid (1) is specially designed to prevent rainwater intrusion by having a front inlet section (8) that has a sloping top (29) which extends beyond a lid door (14) which rests against an upwardly sloping ledge (22). The top lid (1) also has a ridge (24) around the periphery thereof which overlaps and forms a seal over the top (13) of the inner lining (10), thereby further preventing rain from getting into the receptacle and trash from filling between the inside liner (10) and outer container (2). This trash receptacle assembly also has walls (4) on the outer container (2) which can be used as an advertising medium by placing advertising signs (9) thereon.

8 Claims, 2 Drawing Sheets

TRASH RECEPTACLE ASSEMBLY

BACKGROUND OF THE INVENTION

This invention relates to trash containers and more particularly to a trash receptacle assembly having an improved outer container, inner liner and top lid.

Current trash containers, particularly those designed for outdoor use, are subject to many problems. Due to deficiencies in design, such containers allow rain to enter through a door which causes trash contained inside to become very messy and often to heavy for most people to dispose of the trash. Furthermore, the overall design of prior receptacles is such that trash can slip down in-between the outer container and inner liner, again making it difficult when disposing of the trash. Furthermore, the outer container of present receptacles has no hand cut outs to make it easier to remove the inside liner and the liners of the current containers are difficult to remove due to the lack of handles. Thus, there is a need for a new trash receptacle assembly like the present invention, to overcome the above problems.

The relevant prior art consists of numerous U.S. Patents, none of which is like the present invention. For instance, U.S. Pat. No. Des. 270,677 by Creske, dated Sept. 20, 1983, teaches a design for a waste receptacle which appears to be the closest prior patented art to the present invention, but even it differs considerably in design. The top front of the lid in Creske's slopes backward, thereby exposing the container to rain, contrary to the present invention which has a lid which slopes forward beyond the edge of the container, thereby preventing rain from falling into the door of the container. Furthermore, in Creske the top lid is supported on the container rather than the liner, thereby causing trash to slip between the container and the liner making it rather messy and difficult to remove the trash. On the other hand, in the present invention, the lid fits over the inside liner causing it to funnel trash into the liner. In addition, in Creske the outer container has no hand cutouts.

Another U.S. Pat. No. 2,490,790 by Emerson, dated Dec. 13, 1949, features a trash container with a dome-shape top having a swinging lid, but it too suffers from the deficiencies of the Creske patent mentioned above.

Another U.S. Pat. No. 3,096,900 by Breneman, dated July 9, 1963, also teaches a trash container assembly with a top lid. However, Breneman differs from the present invention particularly in the design of the lid as it has a backward sloping top front like Creske. Also, the inner liner and outer container do not have hand holes.

U.S. Pat. No. 3,306,486 by Martino, et al., dated Feb. 28, 1967, is also different as the design of the lid does not prevent rain entering the trash receptacle since it has an inwardly sloping inner ridge (92) in the outer container and the lining does not have hand holes.

Other relevant U.S. Patent documents include U.S. Pat. No. 3,937,335 by Engebretsen, dated Feb. 10, 1976, U.S. Pat. No. 180,277 by Schmitt, dated July 25, 1876, U.S. Pat. No. 3,115,986 by Groff, dated Dec. 31, 1963, and U.S. Pat. No. 2,322,439 by Heithoff, dated June 22, 1943, all of which show trash receptacles considerably different from the present invention.

Contrary to the prior art, the present invention provides an entire trash container assembly having three (3) components: a a top lid, an outside container and an inner liner to hold the trash. The top lid differs in design from any prior receptacle in that it has an extended front with an upwardly sloping lower ridge both which prevent rain from leaking into the container. The container has cutouts on two sides so that a person can easily remove the inner lining from the container. Moreover, in the present invention the lid rests on the container so that it forms a seal between the bag and the liner to prevent garbage from falling between the liner and the container. Finally, the inner liner has tapered vertical sides and hand holes on the top of at least two sides to enable easy removal from the container. Thus, no prior trash container or receptacle includes the same elements or combination of elements as does the present invention.

SUMMARY OF THE INVENTION

An overall object of the present invention is to provide a trash receptacle that maintains trash in a condition for easy disposal later.

Another object of the present invention is to provide such a trash receptacle that keeps the trash in a dry condition by not allowing rain water intrusion.

Another object of the present invention is to provide a trash receptacle that prevents the trash from becoming trapped in the receptacle between the outer container and inner lining.

A further object of the present invention is to provide such a trash receptacle that is less expensive than present receptacles due to its special design.

An even further object of the present invention is to provide such a trash receptacle that can also be utilized as an advertising medium.

The present invention accomplishes the above and other objects by providing a trash receptacle that preferably consists of three (3) components: an outer container, an inner lining for placement inside the outer container and a lid for placement over the container and lining. The outer container has a bottom, enclosed sides and an open top. The liner has a shape similar to the outer container and is sized such that when it is placed inside the outer container its top is slightly higher then the top of the outer container. Finally, the lid contains a ridge around the perimeter so that it rests on the walls of the outer container.

The outer container contains cut-out indentations on the top of at least two sides to make it easy to insert the hands when removing the inner lining for easier trash disposal. The inner lining contains hand holes on two of its sides which align with the cut-out indentations in the outer container so that one can easily pick-up the inner lining when the top lid has been removed. On the trash input side of the top lid contains a sloping top which extends beyond the periphery of the outer container so as to prevent rain from flowing into the container. A swinging door is attached to the trash input side of the lid so that it swings in from the bottom for easy trash disposal. At the bottom of the swinging door, a bottom ledge slopes upwardly and inwardly so that any rainwater will run off said ledge rather into the container. Also, the inside top of the top lid has a ridge around its periphery such that it rests against the inside liner and seals any space between the liner and outer container so that trash does not become trapped between the liner and outer container.

Although it is contemplated that the invention would utilize all three components, the outer container, the inner liner and the top lid, the trash receptacle of this invention could utilize the outer container and lid by itself without the lining or the top may be utilized by itself with another similarly shaped trash receptacle.

Other objects and advantages of the present invention may become more readily apparent when discussed in conjunction with the accompanying drawings.

BRIEF DESCRIPTION OF THE DRAWINGS

The drawing figures used to illustrate the preferred embodiments of the present invention are as follows.

DESCRIPTION OF THE PREFERRED EMBODIMENTS

Figure 1:
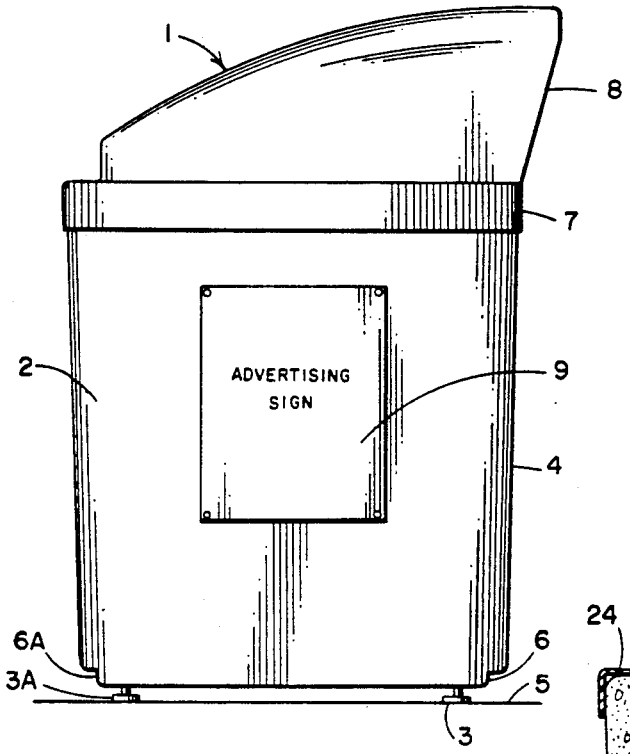
FIG. 1 is a side view of the entire trash receptacle assemble.

Referring now to FIG. 1, the outside of the trash receptacle assembly is shown with the outer container 2 and a removable top lid 1 resting thereon by its base 7. The outer container 2 may rest on casters 3 and 3*a* which may be adjustable depending on the supporting surface 5 on which the receptacle is located. The outer container may have bottom indentations 6 and 6*a* and sloping walls 4. The top lid 1 would contain at one end a trash receiving end 8 for receiving the trash placed into the receptacle.

Figure 2:
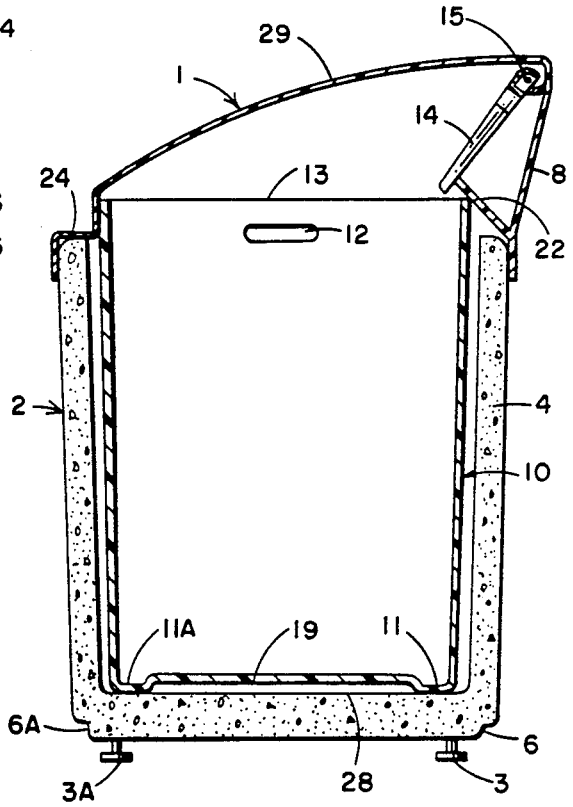
FIG. 2 is a side cross-sectional view of the trash receptacle assembly of FIG. 1.

In FIG. 2 all three components of the trash container receptacle are illustrated—the outer container 2, inner container 10 and top lid 1. Having already described the features of the outer container 2, attention is now directed to the inner lining 10 which is preferably made of a rigid material. The inner lining 10 has hand holes 12 on at least two of its top sides so that someone could easily remove the liner 10 from the outer container 2 by placing hands inside the two cut-outs 12 and lifting upward. The liner has a top 13 which extends higher than the outside container 2 and would touch the lid 1 so that it would form a seal between the top of the liner 13 and the inside periphery of the top lid 1. The top of the liner 13 would also seal against the doorstop ledge 22 of the lid 1 to prevent any garbage or trash from falling between the inner lining 10 and the walls 4 of the outer container. The inside lining 10 also has feet 11 and 11*a* so that the bottom of the liner 19 would not adhere to the inside bottom of the outer container making it even more difficult to remove the inside lining 10 when disposing the trash contained therein.

The final components shown in cross-section FIG. 2 is the top lid 1 which further has a sloping top 29 from the receiving end 8 to its opposite side. At the receiving end a door 14 has a hinge 15 secured inside so that it would swing inward and upward. The sloping top 29 extends beyond the receiving end 8 and swinging door 14 so that rain will not get inside the container. The receiving end 8 also has a doorstop ledge 22 which slants inward and upward to further deter rain and other items from getting into the trash receptacle. The doorstop ledge 22 also extends over the inner lining 10 so that trash does not fall between the liner 10 and outer container 2.

Figure 3:
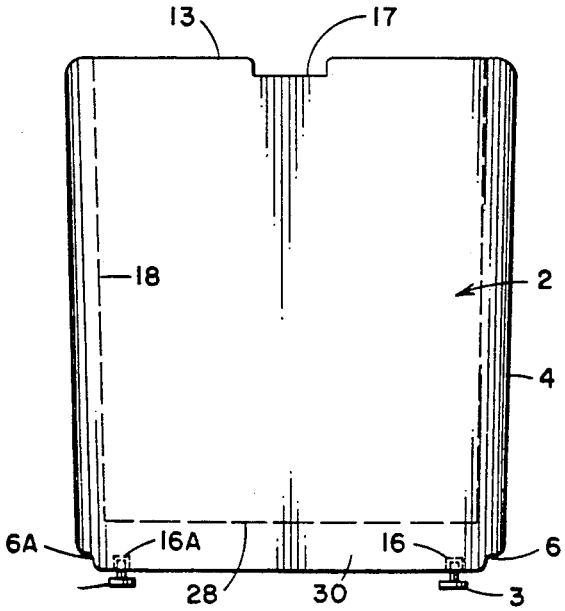
FIG. 3 is a side plan view of the outer container of the trash receptacle.

FIG. 3 shows just the outer container 2. In this view the walls of the container 4 have sufficient thickness and may be made of almost any heavy material, such as concrete, so that the containers could not be easily vandalized or stolen. The inner surface 18 of the outer container might be sloping to allow easy insertion of the liner 10. The casters 3 and 3*a* would be secured by fasteners 16 and 16*a* on the bottom of the container 2 and may allow the caster 13 to be rotated inward or outward for adjustment purposes. The top 13 of the outer container would contain a cut-out 17 on at least two of its sides so that hands could be placed through same and into the hand holes 12 of the inner liner 10 during trash removal.

Figure 4:
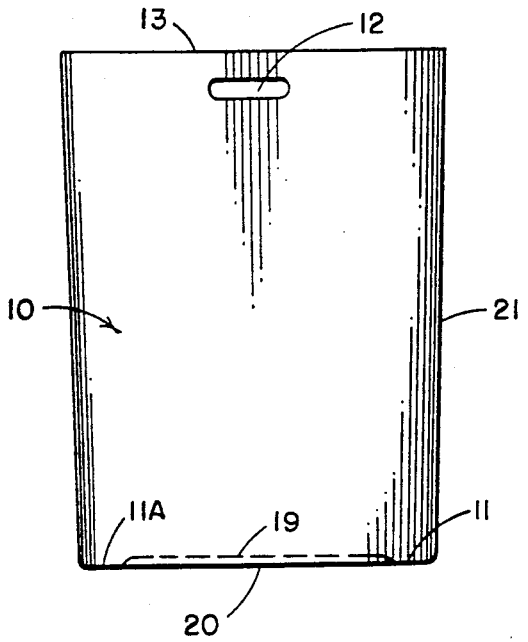
FIG. 4 is a side plan view of the inside liner of the trash receptacle assemble.

FIG. 4 shows the inner lining 10. The inner lining 10 would have sides 21 conforming to the shape of the inner surfaces 18 of the outer container 2 so that it could be inserted easily therein. The inner liner 10 has the hand holes 12 as previously discussed near its top 13. The liner 10 has a bottom 19 which has legs 11 and 11*a* on its circumference to form a base 20.

Figure 5:
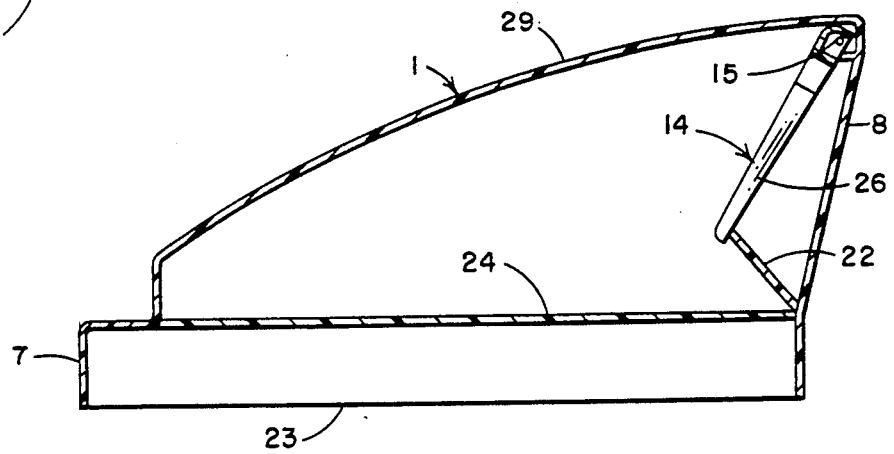
FIG. 5 is a side plan view of the top lid showing the lid door in partial cross-section.
Figure 6:
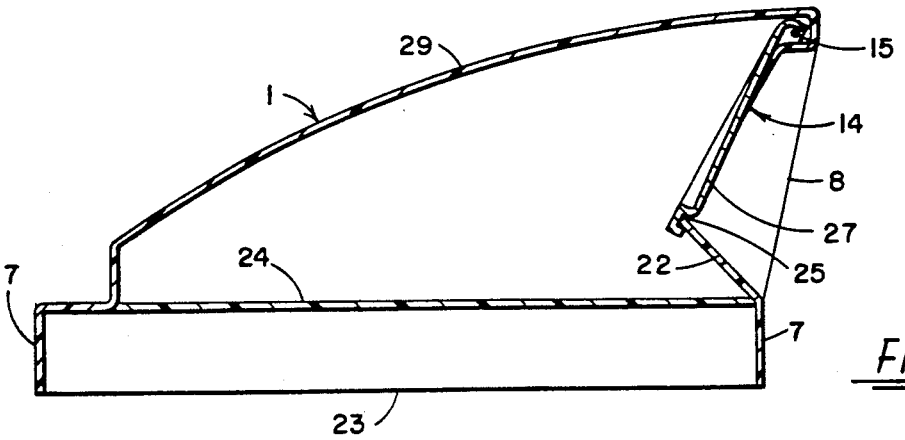
FIG. 6 is a side plan view of the top lid showing the door in full cross-section.

The last two drawing figures, FIG. 5 and FIG. 6, show the top lid 2 by itself. A top lid 1 has a base 7 with a ridge 24 around three sides thereof which rests on the sides of the outer container 1 when in place. The bottom 23 cf the top lid 1 runs around the outer container 1 to form a secure fit when in place so that the top lid 1 does not fall off the outer container 2. The top of the lid 29 slopes from the receiving end 8 toward the back like a roof so that rainwater runs off easily and quickly. The receiving end 8 of the lid 1 extends outwardly beyond the periphery of the receiving end 8 so that water from rain and other elements does not get into the container 2. The receiving end also contains a door 18 attached by a hinge 15 at its top which allows the door 18 to swing inward and upward. The bottom of the door 18 rests by a lip 25 against a doorstop ledge 22 so that it forms a seal with said ledge 22. The exterior edge 26 of the door 18 also forms an enclosure to further prevent the intrusion of elements, such as rain which may be blown at an angle into the receiving end 8. The doorstop ledge 22 is specially designed so that it slopes inward and upward to also cause rainwater to run off. In addition, the ledge 22 extends sufficiently inward so that any trash placed into the container falls well within the inner lining 10 within the container.

Although the outer container 2 would preferably be made of concrete or some other heavy material to prevent removal, vandalism or theft of the trash receptacle, the inner lining 10 and top lid would preferably be made of a rigid material that would be resistant to the elements, particularly in the case of the top lid. Such a material is linear polyethylene made from vacuum molding which is fade and crack resistant. Such a material would enable the top lid 1 to last longer and prevent delayed deterioration from exposure to sunshine in particular.

It is apparent the present invention as described hereinabove provides a novel and non-obvious trash receptacle assembly that offers numerous advantages over the prior art, including, but not limited to, that it maintains the trash in an overall better condition for easy removal by preventing rainwater intrusion and that it causes the trash to be placed into the inner liner of the container by eliminating trash from becoming trapped between the liner and the inside walls of the outer container. Additionally, a special designed cut-out in the outer container and matching hand holes in the inner liner enable one to remove the lining with ease and safety. In addition, the outside of the outer container can be used as an advertising medium by attachment of advertising signs 9 thereto.

A novel and non-obvious trash receptacle assembly having been described hereinabove, modification and improvements thereto within the scope or equivalents of the claims are included in this invention.

Having thus described my invention, I claim:

1. A trash receptacle assembly comprising:

an outer container having a top, a bottom and enclosed sides extending from a periphery of the bottom, said container being open on the top;

a rigid liner for placement inside the outer container, said liner having an open top, a bottom, enclosed sides and being o generally the same shape as the outer container, wherein the sides of the liner extend slightly above the top of the outer container when the liner is placed within said container;

a lid for placement over the outer container and liner, wherein the lid has a trash receiving end;

wherein the outer container contains cut-outs on the top of at least two sides thereof for insertion of the hands to reach the liner which may be placed therein; and wherein the liner has cut-out hand holes near its open top and on at least two sides thereof, said hand holes align with the cut-outs in the outer container.

2. The trash receptacle of claim 1 wherein the liner has an extended leg on the bottom thereof to help prevent the liner from becoming sealed within said container.

3. The trash receptacle assembly of claim 1 wherein the lid has an inlet door located in the trash receiving end, the lid having a top which slopes downward from the trash receiving end to a back, said top of the lid being extended beyond the inlet door so as to prevent rain from falling vertically into the inlet door.

4. The trash receptacle assembly of claim 3 wherein the trash receiving end at the bottom of the inlet door contains an upwardly and inwardly sloping ledge to prevent rainwater intrusion, said ledge protruding inwardly a sufficient amount to extend over the top of the liner so that any trash placed therein falls into the liner.

5. The trash receptacle assembly of claim 4 wherein the inlet door is hinged at the top and swings inward at the bottom, thereof said door having a lip thereof at the bottom thereof which rests securely against the ledge when the door is closed to further prevent intrusion of the rainwater.

6. The trash receptacle assembly of claim 1 wherein the outer container contains casters on the bottom thereof to support said container.

7. The trash receptacle assembly of claim 6 wherein the support casters are adjustable.

8. The trash receptacle assembly of claim 6 wherein the outer container is indented around the periphery of the bottom thereof.

* * * * *